US006096184A

United States Patent [19]

Yoshida et al.

[11] Patent Number: 6,096,184

[45] Date of Patent: Aug. 1, 2000

[54] METHOD OF MANUFACTURING ALUMINUM FOIL FOR ALUMINUM ELECTROLYTIC CAPACITOR

[75] Inventors: Kenji Yoshida, Kyoto; Mitsuhisa Yoshimura, Kadoma; Takahiro Suzuki, Katano; Koichi Kojima, Hirakata, all of Japan

[73] Assignee: Matsushita Electric Industrial Co., Ltd., Osaka, Japan

[21] Appl. No.: 09/115,181

[22] Filed: Jul. 14, 1998

[30] Foreign Application Priority Data

Jul. 25, 1997 [JP] Japan ..... 9-199635

[51] Int. Cl.[7] ..... C25D 11/04

[52] U.S. Cl. ..... 205/153; 205/172; 205/175; 205/704

[58] Field of Search ..... 205/153, 172, 205/175, 704

[56] References Cited

U.S. PATENT DOCUMENTS 5,417,839 5/1995 Sakaguchi et al. ..... 205/153

5,449,448 9/1995 Kurihara et al. ..... 205/153

*Primary Examiner*—Arun S. Phasge

*Attorney, Agent, or Firm*—McDermott, Will & Emery

[57] ABSTRACT

An inventive method of preparing an aluminum foil used in a high voltage aluminum electrolytic capacitor is disclosed. The method involves:

(a) immersing an aluminum foil in a first forming solution, (b) applying a first voltage to said aluminum foil immersed in said first forming solution, (c) immersing said aluminum foil to which said first voltage is applied in a second forming solution, without passing current, and (d) applying a second voltage to said aluminum foil immersed in said second forming solution.

Also disclosed is an aluminum foil that renders an electrolytic capacitor having properties of both high electrostatic capacity and small leak current.

28 Claims, 4 Drawing Sheets

METHOD OF MANUFACTURING ALUMINUM FOIL FOR ALUMINUM ELECTROLYTIC CAPACITOR

TECHNICAL FIELD OF THE INVENTION

The present invention relates to a method of manufacturing an aluminum foil used in an aluminum electrolytic capacitor and to the aluminum foil produced by the method.

BACKGROUND OF THE INVENTION

A conventional high voltage aluminum electrolytic capacitor includes an anode foil having an aluminum foil expanded on the effective surface area by an etching process and an oxide film formed on the surface of the aluminum foil. A capacitor element is composed by winding this anode foil, a cathode foil and a separator between the two foils. By impregnating the capacitor element with a driving electrolyte solution, and sealing the capacitor element in a case, a high voltage aluminum electrolytic capacitor is manufactured.

The oxide film is formed in a forming process, and functions as a dielectric. The forming process, which forms an oxide film on the surface of the aluminum foil to create a high voltage aluminum electrolytic capacitor, is conducted according to the following procedure. Aluminum foil, roughened by an etching process, is boiled in purified water. Consequently, the aluminum foil is placed in an aqueous solution of boric acid, phosphoric acid or a salt thereof, and held at a constant current until reaching the forming voltage. A first forming of an oxide film on the aluminum foil is thus performed, upon reaching the forming voltage, by maintaining a constant voltage for a specific time. Since voids are present inside the formed oxide film, the oxide film is in an unstable state. To remove voids, the formed aluminum foil is depolarized, and an additional layer of oxide film is formed by the above forming process. This process is generally repeated two or three times.

In the forming process, when forming at high voltage using a solution of organic acid as the forming solution, a forming solution of an extremely low concentration must be used in order to prevent discharge thereof. However, since the concentration control of the forming solution is difficult, among other reasons, a forming solution of organic acid is not used. Therefore, hitherto, in order that discharge might not occur if a forming solution of high concentration is required, boric acid, phosphoric acid or salts thereof are used.

When forming solutions of high concentration are used, however, since the aluminum foil is dissolved, or crystallization of oxide film is not promoted, the electrostatic capacity tends to be lower. On the other hand, diammonium adipate is conventionally used as the forming solution of an aluminum foil for low voltage aluminum electrolytic capacitors. If diammonium adipate is used as the forming solution of an aluminum foil for high voltage aluminum electrolytic capacitors, a more crystallized oxide film is formed as compared with the case of using boric acid, phosphoric acid or salts thereof as the forming solution. Although use of diammonium adipate heightens the electrostatic capacity of the electrolytic capacitor, defects in the oxide film are increased. Therefore, the leak current increases, defects in the oxide film are exposed while holding the voltage at the forming voltage in the forming process, and the voltage fluctuates. As a result, stable production of the electrolytic capacitor is impaired.

The present invention hence presents a method of manufacturing aluminum foil for a high voltage electrolytic capacitor having properties of high electrostatic capacity and small leak current.

SUMMARY OF THE INVENTION

A method for manufacturing aluminum foil used in an aluminum electrolytic capacitor of the invention comprises the steps of (a) immersing an aluminum foil a first time in a forming solution, (b) applying a first voltage to the first time immersed aluminum foil, (c) immersing the aluminum foil to which the first voltage is applied a second time in a forming solution, without passing current, and (d) applying a second voltage to the second time immersed aluminum foil.

Preferably, at least one of the first time immersed forming solution and the second time immersed forming solution is an aqueous solution containing diammonium adipate.

Preferably, the value of the second voltage applied is equal to or greater than the value of the first voltage applied.

Preferably, the aluminum electrolytic capacitor is a high voltage aluminum electrolytic capacitor.

A crystallized oxide film is formed on the surface of the aluminum foil when applying the first voltage to the aluminum foil in the first time immersed forming solution. Any defective parts formed in the oxide film are then filled when immersing the aluminum foil in the second time immersed forming solution, without passing current. The defective parts are repaired by the second time immersed forming solution filling the defective parts when the second voltage is applied to the aluminum foil.

In this constitution, a defect-free crystallized oxide film is formed on the surface of the aluminum foil. As a result, an aluminum foil for use in a high voltage electrolytic capacitor having properties of high electrostatic capacity and small leak current is obtained.

DETAILED DESCRIPTION OF THE INVENTION

Figure 1B:
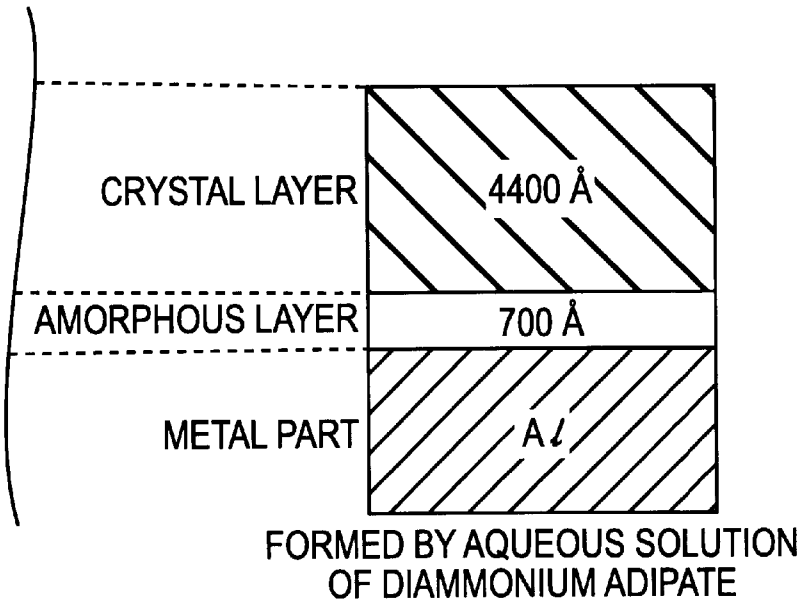
FIG. 1 is a comparative diagram showing the thickness of the crystal layer and the amorphous layer as measured by scanning electron microscope (a) on the section of an oxide film of an aluminum foil formed in a conventional aqueous solution of borate, and (b) on the section of an oxide film of an aluminum foil formed in an aqueous solution of diammonium adipate in accordance with the invention.

A method for manufacturing aluminum foil used in an aluminum electrolytic capacitor of the invention comprises (a) immersing an aluminum foil a first time in a forming solution, (b) applying a first voltage to the first time immersed aluminum foil, (c) immersing the aluminum foil to which the first voltage has been applied a second time in a forming solution, without passing current, and (d) applying a second voltage to the second time immersed aluminum foil.

At step (b), a crystallized oxide film is formed on the surface of the aluminum foil.

At step (c), a defective part formed in the oxide film is filled with the forming solution.

At step (d), the defective part is repaired by the forming solution filling the defective part.

Preferably, the forming solution is an aqueous solution containing diammonium adipate.

Preferably, the aluminum foil is immersed a second time in the forming solution for 30 seconds or more at the step of immersing the aluminum foil to which the first voltage has been applied in the forming solution, without passing the current.

Preferably, at step (c), the aluminum foil to which the first voltage has been applied is immersed in the forming solution, with the voltage being applied or not applied, without passing current.

Preferably, the value of the second voltage applied is greater than or equal to the value of the first voltage applied.

Preferably, the aluminum electrolytic capacitor is a high voltage aluminum electrolytic capacitor.

Preferably, step (b) and step (c) are repeated at least two times.

In this method, crystallization of the oxide film is promoted, and the electrostatic capacity is heightened. By leaving the aluminum foil in the forming solution for 30 seconds or more without passing current while holding the voltage at the forming voltage after the voltage has reached the forming voltage at least one time, the forming solution securely permeates into any defective parts that may be present in the oxide film. In addition, by applying voltage again in the forming solution immersing state, any defective parts in the oxide film are repaired. As a result, an aluminum foil for a high voltage aluminum electrolytic capacitor small in leak current is obtained. Incidentally, if the aluminum foil is left in the forming solution for less than about 30 seconds, the forming solution does not permeate sufficiently into the defective parts in the oxide film, and hence the above effect is small.

In another embodiment of the invention, at least one of the first time immersed forming solution and the second time immersed forming solution is an aqueous solution containing diammonium adipate at a concentration in a range of about 0.008% to about 0.5%.

Preferably, both the first time immersed forming solution and the second time immersed forming solution are aqueous solutions containing diammonium adipate at a concentration in a range of about 0.008% to about 0.5%.

In this method, crystallization of the oxide film is promoted. After the voltage has reached the forming voltage, the power source is cut off, the aluminum foil is left in the forming solution, and the voltage is applied again, so that the effect of filling up any defects in the oxide film can be sufficiently exhibited. If the concentration of the aqueous solution of diammonium adipate is more than about 0.5%, an electric discharge of the forming solution occurs, and the oxide film is not formed sufficiently.

On the other hand, when the concentration is less than about 0.008%, since the conductivity of the forming solution is low, the liquid resistance of the portion of the forming solution permeating into the oxide film is increased, the oxide film forming capability declines, and the above effect of filling up the defects in the oxide film is lowered. Therefore, the concentration of diammonium adipate used as the forming solution is preferred to be in a range of about 0.5% to about 0.008%.

According to another embodiment of the invention, the method comprises (a) immersing an aluminum foil in a forming solution, and (b) applying plural voltages raised sequentially and gradually to the aluminum foil immersed in the forming solution, whereby a crystallized oxide film is formed on the surface of the aluminum foil.

Step (b) may further comprise (1) immersing the aluminum foil to which the voltage is applied in the forming solution, without passing current, after applying at least one of the plural voltages, and (2) applying another voltage which is greater than or equal to the value of at least one of the plural voltages. At this step, any defective parts formed in the oxide film are filled with the forming solution, and the defective parts are repaired by the forming solution filling up the defective parts.

According to this embodiment, in each stage of raising the voltage in two or more stages up to the forming voltage, since the aluminum foil remains in the forming solution for more than 30 seconds without passing current at least once in the process, the forming solution securely permeates into any defective parts in the oxide film. By applying voltage again in the forming solution permeating state, the defective parts in the oxide film are repaired, so that an aluminum foil with less defects and small leak current is obtained.

Preferably, at least one of the first voltage and the second voltage is about 300 V or more. When the forming voltage is about 300 V or more, crystallization of the oxide film is further advanced, and the electrostatic capacity is heightened.

This effect is particularly great when the forming solution is an aqueous solution of diammonium adipate.

Embodiments of the invention are described below.

Figure 1A:
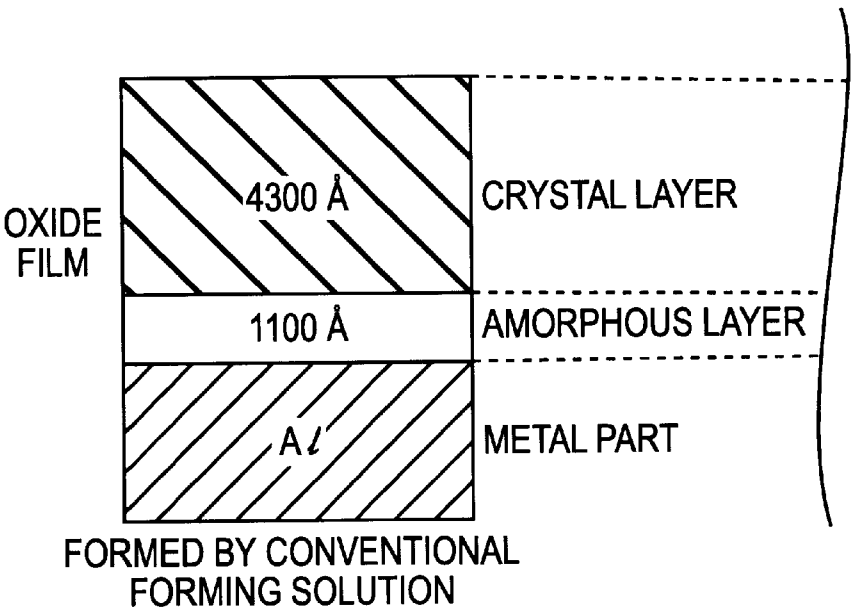
FIG. 1A (PRIOR ART)

FIG. 1 compares the thickness of the crystal layer and the amorphous layer as measured by transmission electron microscope (a) on the section of an oxide film of an aluminum foil formed conventionally in an aqueous solution of borate, and (b) on the section of an oxide film of an aluminum foil formed in an aqueous solution of diammonium adipate in accordance with the invention. As is clear from FIG. 1, the thickness of the crystal layer of the conventional oxide film formed in an aqueous solution of borate is 4,300 angstroms, and the thickness of the crystal layer of the oxide film formed in an aqueous solution of diammonium adipate is 4,400 angstroms. The thickness of the amorphous layer of the conventional oxide film formed in the aqueous solution of borate is 1,100 angstroms, and the thickness of the amorphous layer of the oxide film formed in aqueous solution of diammonium adipate is 700 angstroms. It is thus known that the crystallization is more advanced in the oxide film formed in the aqueous solution of diammonium adipate.

Thus, by using the aqueous solution of diammonium adipate, crystallization of the oxide film is advanced, so that the electrostatic capacity becomes higher. However, due to crystallization of the oxide film, volume shrinkage occurs, thereby increasing defects in the oxide film and the leak current. Accordingly, using the aqueous solution of diammonium adipate, at least one step is provided for leaving the aluminum foil in the forming solution for 30 seconds or more, without passing current, while holding the voltage at the forming voltage after the voltage has reached the forming voltage. By leaving the aluminum foil in the forming solution for 30 seconds or more, without passing current, while holding the voltage at the forming voltage after the voltage has reached the forming voltage, the forming solution permeates into any defective parts in the oxide film. By applying voltage again thereafter, the defective parts in the oxide film are repaired by reforming. Accordingly, an aluminum foil having less defects and smaller leak current is obtained. Moreover, it is free from fluctuation of voltage due to exposure of defects of the oxide film at the forming step, so that stable production is realized.

Figure 2:
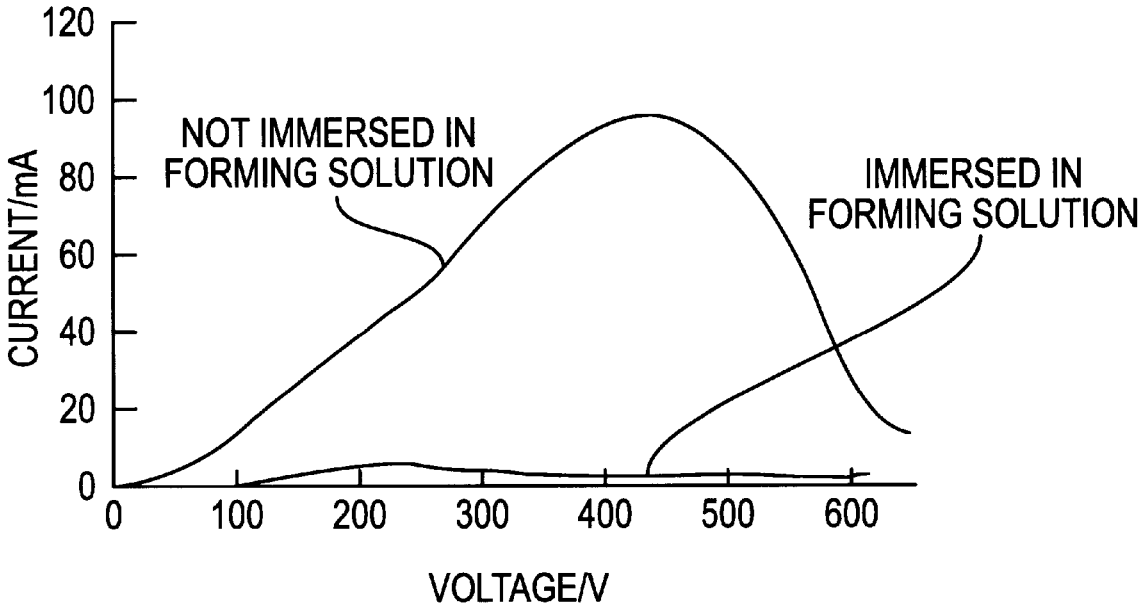
FIG. 2 is a characteristic diagram showing a current-voltage curve measured for evaluating the amount of defects in the oxide film of an aluminum foil after holding at forming voltage, which shows measurement for (a) aluminum foil not immersed in forming solution and (b) aluminum foil immersed in forming solution of diammonium adipate.

FIG. 2 shows a current-voltage curve measured for evaluating the amount of defects in the oxide film of aluminum foil after holding the voltage at the forming voltage. At th(time of voltage sweep, by immersing the oxide film in an aqueous solution of boric acid and sodium borate, a current flows in order to fill up the defective parts in the oxide film. Therefore the current value in the current-voltage curve is higher when there are more defects in the oxide film. That is to say, as is clear from FIG. 2, comparing the current between the aluminum foil undergoing the process of immersing in the forming solution, and the aluminum foil without undergoing the immersing process, the current is lower and defects in the oxide film are fewer in the aluminum foil undergoing the process of being left in the forming solution.

By using the aqueous solution of diammonium adipate, meanwhile, since the aluminum foil is not dissolved, the electric consumption when forming, is smaller as compared with the case of using an aqueous solution of phosphate, and brings about a merit of decreasing the use of electric consumption in the forming process.

In the process of immersing the aluminum foil in the forming solution for 30 seconds or more without passing current, while holding the voltage at the forming voltage, after applying a forming voltage to the aluminum foil, the current is prevented from flowing into the aluminum foil by, for example, inserting an electric insulator at least at one side of the aluminum foil.

In another embodiment, instead of the process of immersing the aluminum foil in the forming solution for 30 seconds or more without passing current, while holding the voltage at the forming voltage after applying the forming voltage to the aluminum foil, it is also possible to immerse the aluminum foil in the forming solution for 30 seconds or more, without passing current, and stopping voltage application after applying the forming voltage to the aluminium foil. In this case, although one step of cutting off the voltage application is increased, the same effects as above are obtained.

Examples of the inventive forming process for forming an aluminum foil and Comparative Examples are described below.

EXAMPLE 1

A roughened aluminum foil was boiled in purified water and immersed in an aqueous solution of diammonium adipate at liquid temperature of 90° C. to form at 580 V. The voltage was raised in three stages until reaching the forming voltage. The concentration of the aqueous solution of diammonium adipate at each stage was 0.5%, 0.1% and 0.01%, respectively. After reaching the forming voltage, without passing current, the aluminum foil was immersed in an aqueous solution of boric acid and sodium borate at 90° C. for 60 seconds. Afterwards, by applying a voltage, the forming voltage was maintained for 30 minutes. Heat treatment and depolarization treatment, such as treatment with phosphoric acid, were conducted. It was then followed by forming again. That is, 580 V is applied in the aqueous solution of boric acid and sodium borate at 90° C. Thus, an aluminum foil was prepared. The electrostatic capacity of the obtained aluminum foil was measured.

EXAMPLE 2

A roughened aluminum foil was boiled in purified water and immersed in an aqueous solution of diammonium adipate at liquid temperature of 90° C. to form at 580 V. The voltage was raised in three stages until reaching the forming voltage, and the concentration of the aqueous solution of diammonium adipate at each stage was 0.5%, 0.1% and 0.01%, respectively. After reaching the forming voltage, without passing current, the aluminum foil was immersed in the aqueous solution of diammonium adipate at 90° C. for 60 seconds. Afterwards, by applying a voltage, the forming voltage was maintained for 30 minutes. Heat treatment and depolarization treatment, such as treatment with phosphoric acid, were conducted. It was then followed by forming again. That is, 580 V is applied in the aqueous solution of diammonium adipate at 90° C. Thus, an aluminum foil was prepared. The electrostatic capacity of the obtained aluminum foil was measured.

EXAMPLE 3

A roughened aluminum foil was boiled in purified water and immersed in an aqueous solution of diammonium adipate at liquid temperature of 90° C. to form at 580 V. The voltage was raised in three stages until reaching the forming voltage, and the concentration of the aqueous solution of diammonium adipate at each stage was 0.5%, 0.1% and 0.01%, respectively. In the process of raising the voltage to the forming voltage at each stage of the three stages, the aluminum foil was immersed in the aqueous solution of diammonium adipate for 60 seconds, without passing current. After reaching the forming voltage, without passing current, the aluminum foil was immersed again in the aqueous solution of diammonium adipate at 90° C. for 60 seconds. Afterwards, by applying a voltage, the forming voltage was maintained for 30 minutes. Heat treatment and depolarization treatment, such as treatment with phosphoric acid, were conducted. It was then followed by forming again. That is, 580 V is applied in the aqueous solution of diammonium adipate at 90° C. Thus, an aluminum foil was prepared. The electrostatic capacity of the obtained aluminum foil was measured.

EXAMPLE 4

A roughened aluminum foil was boiled in purified water, and immersed in an aqueous solution of diammonium adipate at liquid temperature of 90° C. to form at 650 V. The voltage was raised in three stages until reaching the forming voltage, and the concentration of the aqueous solution of diammonium adipate at each stage was 0.5%, 0.1% and 0.01%, respectively. After reaching the forming voltage, without passing current, the aluminum foil was immersed in the aqueous solution of diammonium adipate at 90° C. for 60 seconds. Afterwards, by applying a voltage, the forming voltage was maintained for 30 minutes. Heat treatment and depolarization treatment, such as treatment with phosphoric acid, were conducted. It was then followed by forming again. That is, 580 V is applied in the aqueous solution of diammonium adipate at 90° C. Thus, an aluminum foil was prepared. The electrostatic capacity of the obtained aluminum foil was measured.

COMPARATIVE EXAMPLE 1

A roughened aluminum foil was boiled in purified water and immersed in an aqueous solution of boric acid and sodium borate at liquid temperature of 90° C. to form at 580 V. At this time, the concentration of the aqueous solution of boric acid and sodium borate was 8%/0.04%. After reaching the forming voltage, this state was maintained for 30 minutes. Heat treatment and depolarization treatment, such as treatment with phosphoric acid, were conducted. It was then followed by forming again. Thus, an aluminum foil was prepared. The electrostatic capacity of the obtained aluminum foil was measured.

COMPARATIVE EXAMPLE 2

A roughened aluminum foil was boiled in purified water and immersed in an aqueous solution of boric acid and sodium borate at liquid temperature of 90° C. to form at 650 V. At this time, the concentration of the aqueous solution of boric acid and sodium borate was 8%/0.01%. After reaching the forming voltage, this state was maintained for 30 minutes. Heat treatment and depolarization treatment, such as treatment with phosphoric acid, were conducted. It was then followed by forming again. Thus, an aluminum foil was prepared. The electrostatic capacity of the obtained aluminum foil was measured.

COMPARATIVE EXAMPLE 3

A roughened aluminum foil was boiled in purified water and immersed in an aqueous solution of diammonium adipate at liquid temperature of 90° C. to form at 580 V. The voltage was raised in three stages until reaching the forming voltage, and the concentration of the aqueous solution of diammonium adipate at each stage was 0.5%, 0.1% and 0.01%, respectively. After reaching the forming voltage, it was held at the forming voltage for 30 minutes in the aqueous solution of diammonium adipate. Heat treatment and depolarization treatment, such as treatment with phosphoric acid, were conducted. It was then followed by forming again. Thus, an aluminum foil was prepared. The electrostatic capacity of the obtained aluminum foil was measured.

Figure 3:
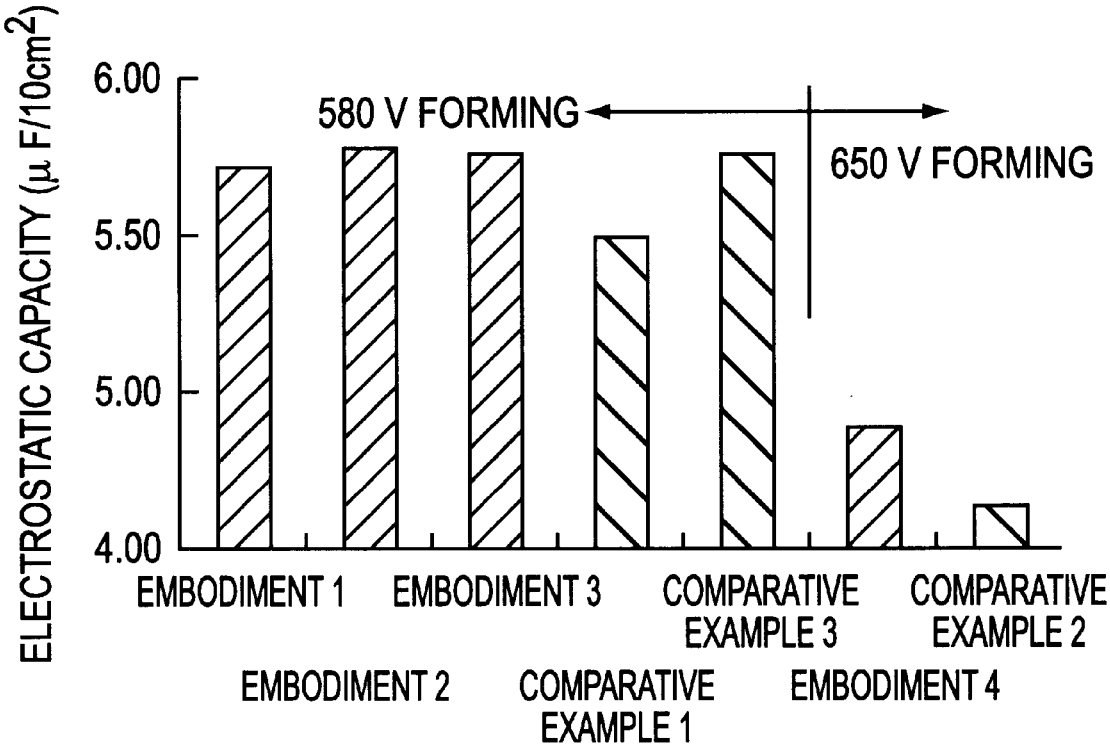
FIG. 3 is a characteristic diagram showing the results of measurement of electrostatic capacity in oxide films obtained in (a) Examples 1 to 4 of the invention and (b) Comparative Examples 1 to 3.
Figure 4:
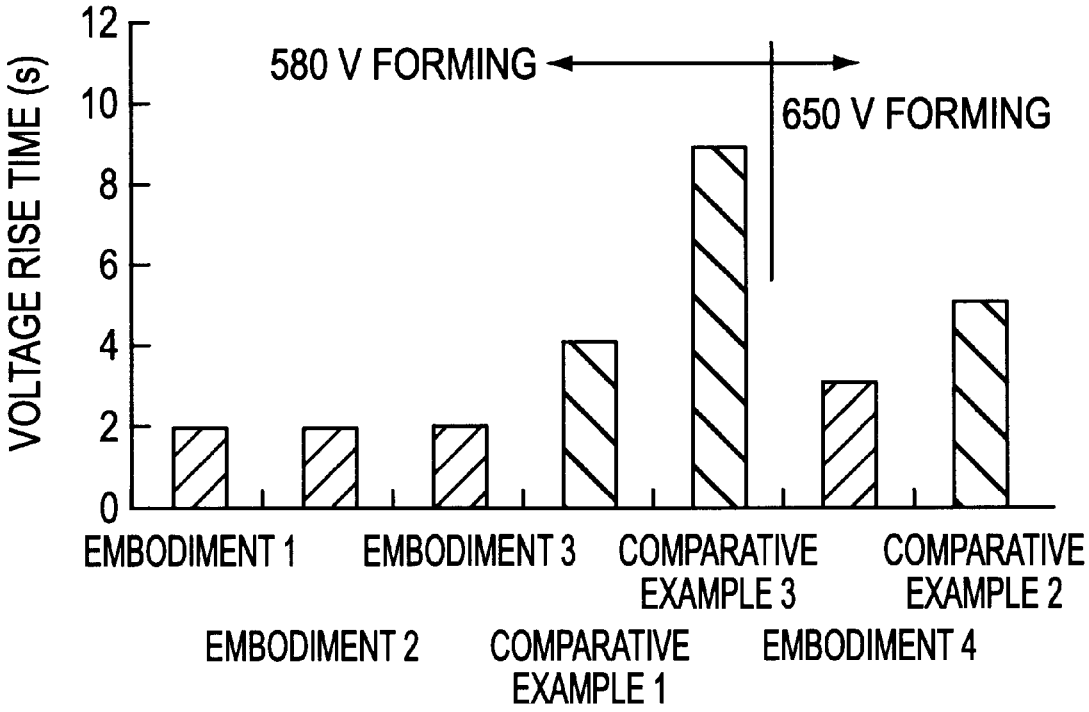
FIG. 4 is a characteristic diagram showing the time required for the voltage to climb up to the forming voltage, by passing a constant current to the oxide film when formed according to the conditions in (a) Examples 1 to 4 of the invention and (b) Comparative Examples 1 to 3.

In the aluminum foils obtained in Examples 1 to 4 of the invention and Comparative Examples 1 to 3, the electrostatic capacity was measured. The results are shown in FIG. 3. FIG. 4 shows the time required for reaching the forming voltage (that is, the voltage rise time) by passing a constant current to the aluminum foil prepared by forming in the conditions in Examples 1 to 4 of the invention and Comparative Examples 1 to 3.

As is clear from FIG. 3, in forming at 580 V, in Examples 1, 2 and 3 in accordance with the invention and in Comparative Example 3, wherein an aqueous solution of diammonium adipate was used as the forming solution, the electrostatic capacity was increased by about 5% as compared with Comparative Example 1 formed by using the conventional forming solution. In forming at 650 V, in Example 4 of the invention, wherein an aqueous solution of diammonium adipate was used as the forming solution, the electrostatic capacity was increased by about 5% as compared with Comparative Example 2 formed using the conventional forming solution. The increase of the electrostatic capacity is attributable to the promotion of crystallization of the oxide film as shown in FIG. 1.

In the comparison of the voltage rise time of the aluminum foil in FIG. 4, in forming at 580 V, in Examples 1, 2 and 3 of the invention of immersing the aluminum foil in the forming solution after reaching the forming voltage, and then applying voltage, as compared with Comparative Examples 1 and 3, which involve not immersing the foil in the forming solution, the voltage rise time is shorter. In forming at 650 V, on the other hand, in Example 4 of the invention, wherein the aluminum foil is immersed in the forming solution after reaching the forming voltage, and then applying voltage, as compared with Comparative Example 2, which involves not immersing the foil in the forming solution, the voltage rise time is also shorter. Thus, defects in the oxide film are decreased.

Thus, according to the manufacturing method of the invention, by using an aqueous solution of diammonium adipate in the forming solution until the voltage reaches the forming voltage, or by using the forming solution after the voltage reaches the forming voltage until the voltage is held at the forming voltage, crystallization of the oxide film is promoted, and hence the electrostatic capacity is heightened. Further, after reaching the forming voltage, by the process of immersing the aluminum foil in the forming solution for 30 seconds or more without passing current, the forming solution permeates into the defective parts in the oxide film. By applying voltage again in the forming solution permeating state, the defective parts of the oxide film are repaired, so that an aluminum foil for high voltage aluminum electrolytic capacitor small in leak current may be obtained.

What is claimed is:

1. A method for manufacturing aluminum foil used in an aluminum electrolytic capacitor, comprising:

(a) immersing an aluminum foil a first time in a forming solution, (b) applying a first voltage to said first time immersed aluminum foil, (c) immersing said aluminum foil to which said first voltage is applied a second time in said forming solution, without passing current, and (d) applying a second voltage to said second time immersed aluminum foil.

2. The method of claim 1, wherein said forming solution is an aqueous solution containing diammonium adipate.

3. The method of claim 1, wherein said aluminum foil is immersed in said forming solution for 30 seconds or more during said second time immersion without passing current.

4. A method for manufacturing aluminum foil used in an aluminum electrolytic capacitor, comprising:

(a) immersing an aluminum foil a first time in a forming solution, (b) applying a first voltage to said first time immersed aluminum foil, whereby an oxide film, is formed on a surface of said aluminum foil, said oxide film includes a crystallized oxide film, (c) immersing said aluminum foil containing said oxide film a second time in said forming solution, without passing current, whereby a defective part formed in said oxide film is filled with said forming solution, and (d) applying a second voltage to said second time immersed aluminum foil, whereby said defective part is repaired by said forming solution filling up said defective part during said second time immersion.

5. The method of claim 4, wherein said forming solution is an aqueous solution containing diammonium adipate.

6. The method claim 1 or 4, wherein said aluminum foil used in said step (a) is an aluminum foil boiled in purified water.

7. A method for manufacturing aluminum foil used in an aluminum electrolytic capacitor, comprising:

(a) immersing an aluminum foil a first time in a forming solution, (b) applying plural voltages elevating sequentially and gradually to said first time immersed aluminum foil, whereby an oxide film is formed on a surface of said aluminum foil, said oxide film includes a crystallized oxide film, (c) immersing said aluminum foil containing said oxide film a second time in said forming solution, without passing current, whereby a defective part formed in said oxide film is filled with said forming solution, and (d) applying a second voltage to said second time immersed aluminum foil, whereby said defective part is repaired by said forming solution filling up said defective part.

8. The method of claim 4 or 7, wherein said aluminum foil is immersed in said forming solution for 30 seconds or more in said second time immersion, without passing current.

9. The method of claim 7, wherein said forming solution is an aqueous solution containing diammonium adipate.

10. The method of claim 1, 4 or 7, wherein said second voltage is greater than or equal to said first voltage.

11. The method of claim 1, 4 or 7, wherein said steps (b) and (c) are repeated at least two times.

12. The method of claim 1, 4 or 7, wherein said second voltage is 300 V or more.

13. The method of claim 1, 4 or 7, wherein at said step (c) and (d) said aluminum foil to which said first voltage is applied is immersed in a second forming solution, without applying voltage and without passing current, and then said second voltage is applied to said aluminum foil immersed in said second forming solution.

14. The method of claim 1, 4 or 7, wherein at said step (c) and (d) said aluminum foil to which said first voltage is applied is immersed in a second forming solution, by applying voltage and without passing current, and then said second voltage is applied to said aluminum foil immersed in said second forming solution.

15. A method for manufacturing aluminum foil used in an aluminum electrolytic capacitor, comprising:

(a) immersing an aluminum foil in a forming solution, and (b) applying plural voltages elevating sequentially and gradually to said aluminum foil immersed in said forming solution, whereby an oxide film is formed on a surface of said aluminum foil, said oxide film includes a crystallized oxide film, wherein said step (b) comprises:

(1) immersing said aluminum foil to which said voltage is applied in said forming solution, without passing current, after applying at least one of the plural voltages, whereby a defective part formed in said oxide film is filled with said forming solution, and (2) applying a subsequent voltage which is greater than or equal to the value of a preceding voltage, whereby said defective part is repaired by said forming solution filling up said defective part.

16. The method of claim 1, 4, 7 or 15, wherein said forming solution is an aqueous solution containing diammonium adipate at concentration in a range of about 0.008% to about 0.5%.

17. The method of claim 1, 4, 7 or 15, wherein said aluminum electrolytic capacitor is a high voltage aluminum electrolytic capacitor.

18. The method of claim 15, wherein said forming solution is an aqueous solution containing diammonium adipate.

19. The method of claim 15, wherein said aluminum foil is immersed in said forming solution for 30 seconds or more in the step of immersing said aluminum foil to which said voltage is applied in said forming solution, without passing current.

20. A method for manufacturing aluminum foil used in an aluminum electrolytic capacitor, comprising:

(a) immersing an aluminum foil in a first forming solution, (b) applying a first voltage to said aluminum foil immersed in said first forming solution, (c) immersing said aluminum foil to which said first voltage is applied in a second forming solution, without passing current, and (d) applying a second voltage to said aluminum foil immersed in said second forming solution.

21. The method of claim 20, wherein upon applying said first voltage to said aluminum foil immersed in said first forming solution, an oxide film is formed on a surface of said aluminum foil, upon immersing said aluminum foil to which said first voltage is applied in a second forming solution, without passing current, a defective part formed in said oxide film is filled with said second forming solution, and upon applying a second voltage to said aluminum foil immersed in said second forming solution, said defective part is repaired by said second forming solution filling up said defective part.

22. The method of claim 21, wherein said oxide film includes a crystallized oxide film, and said defective part formed in said crystallized oxide film is filled with said second forming solution.

23. The method of claim 20, wherein at least one of said first forming solution and said second forming solution is an aqueous solution containing diammonium adipate.

24. The method of claim 20, wherein at said step (c) and (d) said aluminum foil to which said first voltage is applied is immersed in a second forming solution, without applying voltage and without passing current, and then said second voltage is applied to said aluminum foil immersed in said second forming solution.

25. The method of claim 20, wherein at said step (c) and (d) said aluminum foil to which said first voltage is applied is immersed in a second forming solution, by applying voltage and without passing current, and then said second voltage is applied to said aluminum foil immersed in said second forming solution.

26. The method of claim 20, at least one of said first forming solution and said second forming solution is an aqueous solution containing diammonium adipate at a concentration in a range of about 0.008% to about 0.5%.

27. The method of claim 20, wherein said aluminum electrolytic capacitor is a high voltage aluminum electrolytic capacitor.

28. An electrolytic capacitor, comprising an aluminum foil prepared by the method according to claim 20.

* * * * *